US008146459B2

(12) United States Patent
Wilson

(10) Patent No.: US 8,146,459 B2
(45) Date of Patent: Apr. 3, 2012

(54) OPENER FOR PLASTIC BOTTLE TWIST CAPS

(76) Inventor: Roger F. Wilson, Sarasota, FL (US)

( * ) Notice: Subject to any disclaimer, the term of this patent is extended or adjusted under 35 U.S.C. 154(b) by 379 days.

(21) Appl. No.: 12/580,674

(22) Filed: Oct. 16, 2009

(65) Prior Publication Data

US 2010/0116095 A1 May 13, 2010

Related U.S. Application Data

(60) Provisional application No. 61/113,392, filed on Nov. 11, 2008.

(51) Int. Cl.
*B25B 7/18* (2006.01)
*B25B 7/14* (2006.01)

(52) U.S. Cl. ..... 81/3.44; 81/3.07

(58) Field of Classification Search ..... 81/3.4, 81/3.44, 3.07; D8/33, 40, 43
See application file for complete search history.

(56) References Cited

U.S. PATENT DOCUMENTS 1,261,458 A * 4/1918 Tate ..... 53/317
2,463,525 A * 3/1949 Deming ..... 81/97
6,679,138 B2 * 1/2004 Battles et al. ..... 81/3.44
6,971,282 B2 * 12/2005 Bathey ..... 81/3.44

* cited by examiner

*Primary Examiner* — David B Thomas
(74) *Attorney, Agent, or Firm* — Caesar, Rivise, Bernstein, Cohen & Polotilow, Ltd.

(57) ABSTRACT

A device for enabling the unscrewing of a cap from a bottle or jar is disclosed. The device is in the form of a somewhat elongated body in which a releasably engageable cam member and a torsion spring are located. The body is arranged to be grasped by a user of the device. The body includes a pair of cavities, each arranged for receipt of a cap of a bottle or jar therein. The cam member has a pair of ridged or serrated surfaces which are normally biased into the cavities by the spring to releasably engage a portion of the periphery of a cap disposed within either cavity.

8 Claims, 3 Drawing Sheets

Fig. 5
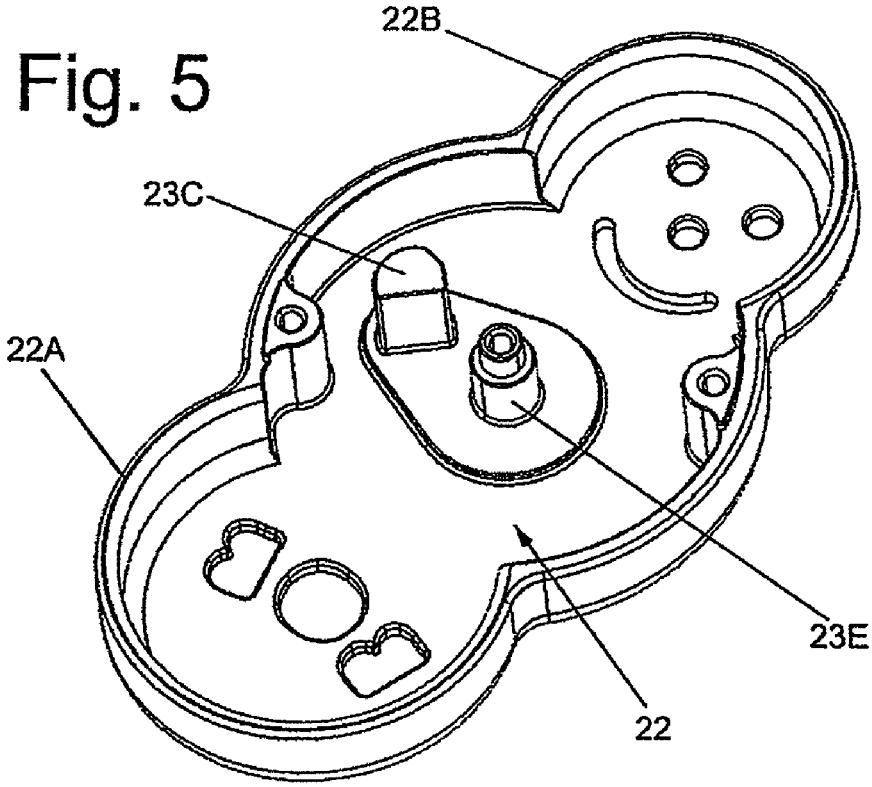
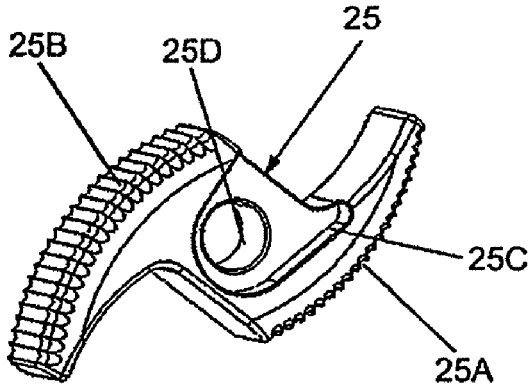
Fig. 6
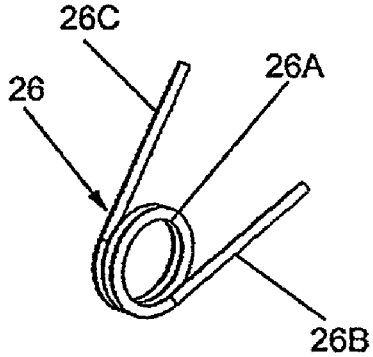
Fig. 7

OPENER FOR PLASTIC BOTTLE TWIST CAPS

CROSS-REFERENCE TO RELATED APPLICATIONS

This application claims priority from U.S. Provisional Application Ser. No. 61/113,392, filed on Nov. 11, 2008, entitled Opener for Plastic Bottle Twist Caps, whose disclosure is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

BACKGROUND OF THE INVENTION

This invention provides an improved device for assisting in the opening of a wide range of common plastic bottle twist caps by increasing grip and leverage to the cap with an unprecedented ratcheting function that decreases the angular deflection demands on the user's wrists. Rotation is thus optionally broken down into multiple small movements or less larger movements depending on the user's desire. To maximize effectiveness the device accommodates a wide range of sizes.

Since their introduction plastic twist caps continue to be difficult to open for many users. While the integrity of the cap's robust seal ensures against content contamination and leakage, it is often a problem to achieve adequate cap grip to transfer the necessary torque required to break the seal. This is especially true for those with limited strength or physical impairment.

Many devices are widely known on the marketplace developed over the years in an attempt to mitigate this trouble. However previous devices have suffered poor effectiveness due to various shortcomings such as limited capability, ease of use, comfort, and or slippage due to a lack of traction or grip. Through an improved design, the current invention eliminates or renders insignificant the shortcomings of the prior devices while adding advantages heretofore not available.

The main body of the current invention has a comfortably pleasing shape that, in the preferred exemplary embodiment it includes two separate apertures each offering a different and slightly overlapping range of cap size capability. Located between the two cap apertures is a center portion housing a single rotatable cam with two contoured surfaces shaped for the purpose of engaging the bottle cap positioned in either aperture. The cam is additionally spring loaded to facilitate immediate engagement with the cap. Further, the cam shape is designed in conjunction with its surface roughness to ensure a progressive and adequate grip with the cap in order a user may break the seal without slippage. It should be noted that the progressive mechanical advantage and grip afforded by this specially shaped cam geometry is attained without any additional demand or detrimental effects to the user.

Another significant improvement over prior devices afforded by the current invention is the capability to ratchet the device thereby minimizing the degree of angular deflection required of the user's wrist. This ratcheting capability is achieved by again carefully designing the cam and its engagement surface in combination with the torsion spring that instantly releases the pressure and grip on the cap with clockwise rotation (or rotation opposite that needed to release the cap). It will be readily recognized that this fine ratcheting feature offers the possibility of minimal angular deflection of the user's wrist. Of course while the ratcheting feature improves function of the device for all users it is especially beneficial to those suffering limiting or painful physical condition such as arthritis.

It will also be duly noted that in order to achieve the aforementioned ratcheting capability the cam is configured to operate only in the one direction which causes release or unscrewing of the bottle cap. The reasoning being that the initial loosening of the cap is the greatest problem to manage, subsequent retightening or securing of the cap to prevent leakage is not a problem or concern.

While the device is intended primarily for use with plastic bottles and caps, it will be recognized that there will be a number of bottles or jars or other vessels with metal or plastic caps to which this invention has applicability to facilitate the removal of such caps.

While the preferred exemplary embodiment utilizes one cam with two separate surfaces to react against the caps it will be recognized by anyone skilled in the art that two or more cams could be employed to the same result albeit at the expense of increased complexity and cost. Also in consideration of manufacturability, it will be recognized that in one preferred aspect of the invention the main body of the device and the various components could all be made in a plastic material which is easily and cheaply molded in great quantity. In accordance with another preferred aspect of the invention the main body and cover are made in plastic while the cam is made of metal.

In accordance with another preferred aspect of the invention the cam is a single component that includes a spring which biases the cam against the bottle cap.

SUMMARY OF THE INVENTION

In accordance with one preferred aspect of this invention there is provided a device for enabling the unscrewing of a cap from a bottle or jar. The device basically comprises a body (e.g., a generally planar member with an upstanding peripheral wall), a releasably engageable member (e.g., a cam having serrations thereon) and a biasing member (e.g., a torsion spring). The body of the device is arranged to be grasped by a user of the device and includes at least one cavity for receipt of a cap of a bottle or jar therein. The releasably engageable member has an engagement surface. The biasing member is arranged to normally bias the engagement surface into the at least one cavity to releasably engage a portion of the periphery of a cap disposed within that cavity.

In accordance with one preferred embodiment of the invention the main body contains two apertures or cavities for receiving a range of bottle caps. Positioned between the two cavities is the releasable engagement member (e.g., a single cam with two surface geometries) for the purpose of engaging the bottle caps placed within their respective cavities.

In accordance with another aspect of the invention the engagement surfaces of the cam include ridges or serrations for the purpose of improving engagement or bite with the respective bottle cap.

BRIEF DESCRIPTION OF SEVERAL VIEWS OF THE DRAWING

FIG. 5 is a view similar to FIG. 4, but with the torsion spring and cam removed;

FIG. 6 is an isometric view of the cam 25; and

FIG. 7 is an isometric view of the torsion spring 26.

DETAILED DESCRIPTION OF THE PREFERRED EMBODIMENT

Figure 1:
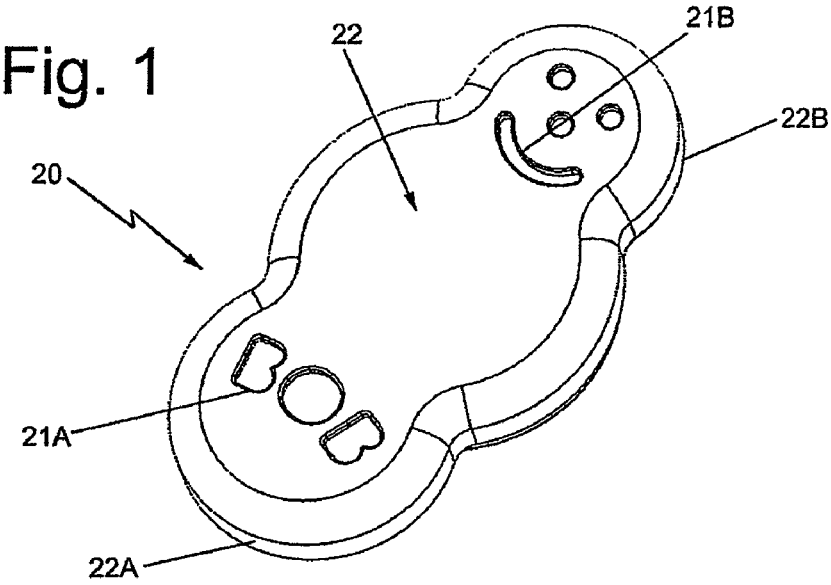
FIG. 1 is an isometric view of the top side of the device.

Referring now to the various figures of the drawing wherein like reference characters refer to like parts, there is shown in FIG. 1 a bottle cap removing device 20 constructed in accordance with one exemplary embodiment of this invention. The device 20 basically comprises a main body portion 22, a cam 25 (FIG. 3), a washer/spacer 30 (FIG. 3), a torsion spring 26 (FIGS. 3, 4 and 7), and a cover 27. The main body portion is a generally planar member having an upstanding peripheral wall or skirt whose end portions 22A and 22B are of arcuate shape (e.g., they each constitute a segment or arc of a circle). The end portion 22A is of larger radius than the end portion 22B. In the interest of aesthetics the main body portion 22 includes areas that have been engraved, e.g., one area 21A includes indicia of the word "BOB" and the other area 21B includes indicia of a smiley face. It should be appreciated that the engravings 21A and 21B are not functional, but are provided purely for cosmetic enhancement and product identification.

Figure 2:
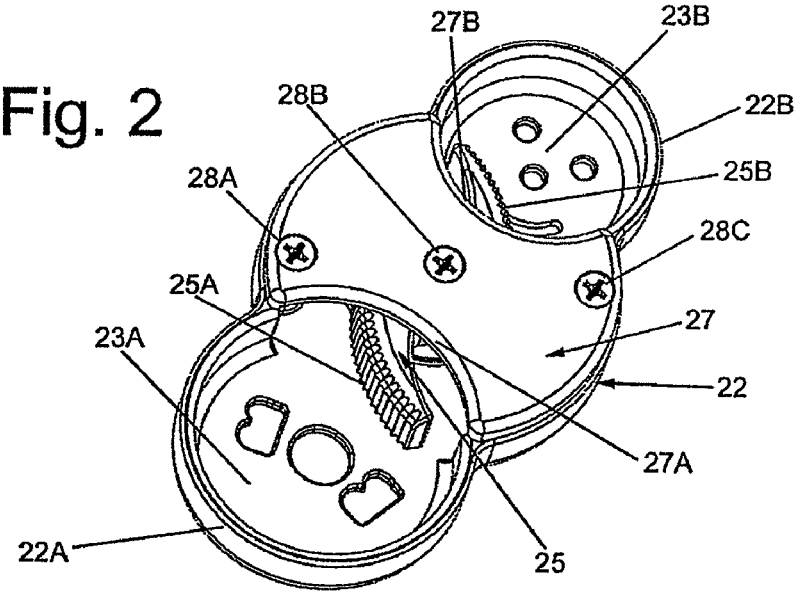
FIG. 2 is another isometric view of the device from the underside.

Referring to FIG. 2 the cover 27 captivates and shields the user from the internal parts of the device 20, namely, the cam 25, the washer/spacer 30, and the torsion spring 26. The cover 27 is held in place by three screws 28A, 28B, and 28C extending into respective threaded bosses of the body portion 22. The periphery of the cover 27 is in the form of an opposed pair of arcuate recesses 27A and 27B. The recess 27A constitutes a segment of an arc, whose radius is the same as that of the skirt portion 22A. The recess 27A and the skirt portion 22A together define a circular cavity 23A arranged for receipt of a cap therein. In a similar manner, recess 27B constitutes a segment of an arc, whose radius is the same as that of the skirt portion 22B. The recess 27B and the skirt portion 22B together define another circular cavity 23B arranged for receipt of a smaller size cap therein.

The cam 25 is a one-piece member that includes a pair of ridged or serrated surfaces 25A and 25B (to be described later), which are arranged to engage or grip a portion of the periphery of any cap that is inserted in one of the device's cavities 23A or 23B. The cam 25 is arranged to be biased into its associated cavity and hence into engagement with any cap disposed in that cavity by the torsion spring 26. To that end the spring 26 is mounted on a round boss 23E (FIG. 5) projecting upward from the interior of the main body portion 22.

Figure 3:
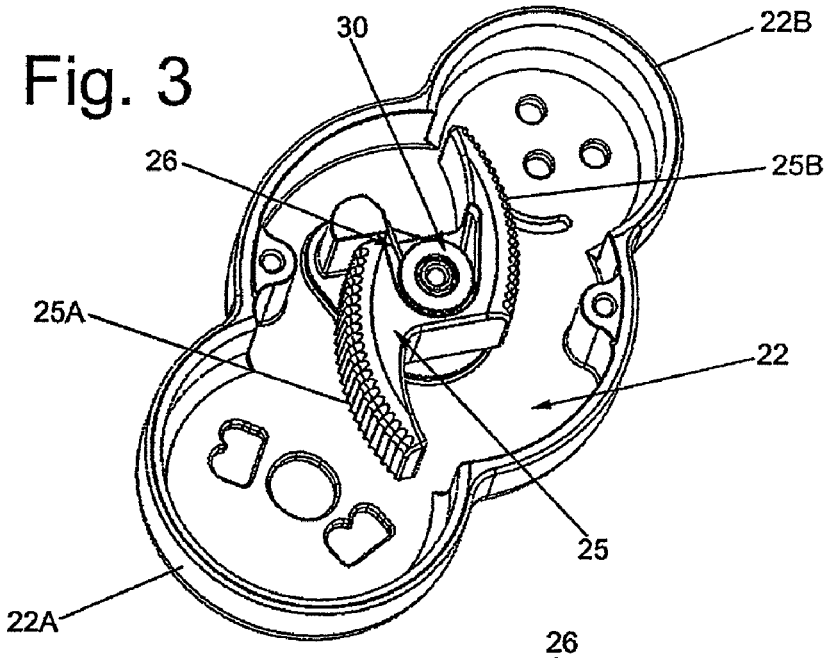
FIG. 3 is a view similar to FIG. 2, but with a portion of the device, i.e., the cam's cover, removed to show the internal portions and parts, e.g., the washer, the cam, and the torsion spring.

As best seen in FIG. 3 a washer/spacer 30 is provided on the boss to keep the spring 26 properly axially located on the boss 23E.

As best seen in FIGS. 3, 4, 5, and 6 the cam 25 is pivotably mounted on the boss 23E. To that end, the cam includes a central hole 25D, which fits over the boss 23E. The cam is arranged to pivot or rotate about the axis of boss 23E. As mentioned earlier the cam 25 includes two slightly varied ridged or serrated engagement arcuate surfaces, 25A and 25B. The surface 25A of the cam 25 is located adjacent the cavity 23A, while the surface 25B of the cam 25 is located adjacent the cavity 23B. The cam 25 is biased by the spring 26 so that its surface 25A moves into the cavity 22A, while its surface 25B moves into cavity 22B to tightly sandwich any cap disposed in that cavity between the ridged surface and the portion of the sidewall defining that cavity. The ridges or serrations improve the grip or traction with the appropriate cap mating surface. With the cap being tightly engaged by the ridged or serrated surface, the user can then twist the device 20 and/or the bottle or jar on which the cap is disposed to apply significant torque to the cap to remove it.

Figure 4:
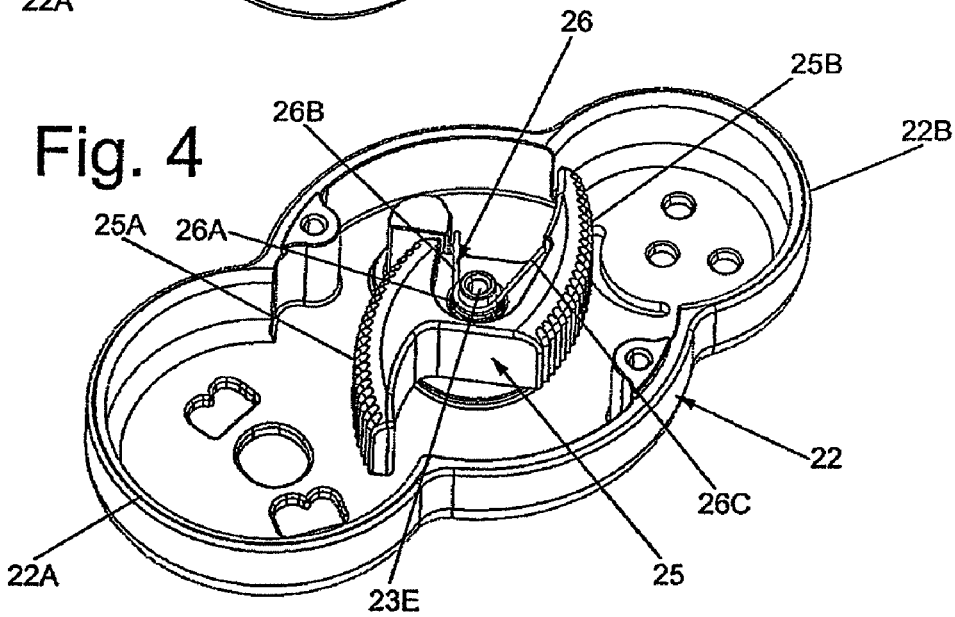
FIG. 4 is a view similar to FIG. 3, but with the washer/spacer removed better showing the torsion spring.

As best shown in FIGS. 4 and 7 the torsion spring 26 includes a central portion in the form of a coil 26A, which is disposed on the boss 23E and a pair of linear end portions 26B and 26C. The spring portion 26C is arranged to engage a cam shelf portion 25C on the cam. The other linear portion 26B of the spring is arranged to engage a boss 23C that projects upward from the interior of the main body portion 22. Thus, the spring reacts between boss 23C and cam shelf 25C ensuring that the cam 25 presses against any bottle cap located within either of the cavities 23A or 23B, thereby providing the initial traction. Such traction, in conjunction with the geometry of the cam and continued twisting of the device 20 and/or the bottle on which the cap is disposed, combine to create sufficient grip between the cam and the cap to prevent slippage. This action enables transference of the necessary torque to break the cap loose and facilitate removal.

As should be appreciated from the foregoing the device of this invention is simple in construction, can be low in cost, yet is particularly suitable for assisting in loosening twist caps from bottles. To that end it basically comprises a primary body portion with a rotatable cam mounted therein for the purpose of engaging a bottle cap placed within a cap-receiving cavity in the main body. The cam is arranged centrally within the main body and is pivotable in a way that allows engagement with the cap of a bottle inserted in the appropriate cavity of the main body. The configuration of the cam is such that as force is applied in rotating the device to unscrew the cap, the grip or clamping forces between the cam and cap increase very quickly thus preventing slippage and thereby ensuring the opening of the bottle.

While the invention has been described in detail and with reference to specific embodiment shown herein, it will be apparent to one skilled in the art that various changes and modifications can be made therein without departing from the spirit and scope thereof.

I claim:

1. A device for enabling the unscrewing of a cap from a bottle or jar, said device comprising a body, a releasably engageable member and a biasing member, said body comprising a pair of cavities, each of said cavities being arranged for receipt of a cap of a bottle or jar therein, said body being arranged to be grasped by a user of the device, said releasably engageable member having a pair of engagement surfaces, said biasing member being arranged to bias one of said engagement surfaces into one of said cavities to releasably engage a portion of the periphery of a cap disposed within said one of said cavities, said biasing member also being arranged to bias the other of said engagement surfaces into the other of said cavities to releasably engage a portion of the periphery of a cap disposed within said other of said cavities.

2. The device of claim 1 wherein said releasably engageable member is a cam member.

3. The device of claim 1 wherein said biasing member comprises a torsion spring.

4. The device of claim 1 wherein said body comprises an elongated generally planar member having an upstanding peripheral wall, said wall defining said pair of cavities.

5. The device of claim 4 wherein said upstanding peripheral wall comprises a pair of end portions and wherein said pair of cavities are located at respective ones of said opposite end portions of said upstanding peripheral wall.

6. The device of claim 4 additionally comprising a cover secured to a portion of said peripheral wall over said releasable engagement member to shield the user therefrom.

7. The device of claim 1 wherein said cavities are of different sizes.

8. The device of claim 1 wherein said engagement surfaces are ridged or serrated.

* * * * *